US006431785B1

(12) United States Patent
Melander

(10) Patent No.: US 6,431,785 B1
(45) Date of Patent: Aug. 13, 2002

(54) DIRECT PIN QUICK COUPLER

(75) Inventor: Michael Melander, Diamond Bar, CA (US)

(73) Assignee: WEC Co., Gardner, MA (US)

( * ) Notice: Subject to any disclaimer, the term of this patent is extended or adjusted under 35 U.S.C. 154(b) by 0 days.

(21) Appl. No.: 09/587,731

(22) Filed: Jun. 5, 2000

(51) Int. Cl.[7] ..... E02F 3/96; E02F 9/00
(52) U.S. Cl. ..... 403/322.1; 403/321; 414/723
(58) Field of Search ..... 403/321, 322.1, 403/324, 315, 316; 414/723; 37/468; 172/272, 273, 274, 275

(56) References Cited

U.S. PATENT DOCUMENTS

| | | | | |
|---|---|---|---|---|
| 2,984,985 | A | | 5/1961 | MacMillin |
| 3,231,116 | A | | 1/1966 | Powell |
| 3,269,570 | A | | 8/1966 | Wallberg |
| 3,633,460 | A | | 1/1972 | Ohniwa et al. |
| 3,691,908 | A | | 9/1972 | Hackmann et al. |
| 3,767,070 | A | | 10/1973 | Arnold |
| 3,782,249 | A | | 1/1974 | Drone |
| 3,854,608 | A | | 12/1974 | Arnold |
| 3,871,266 | A | | 3/1975 | Schwab et al. |
| 3,876,091 | A | | 4/1975 | MacDonald |
| 3,934,738 | A | | 1/1976 | Arnold |
| 3,952,431 | A | | 4/1976 | Gledhill et al. |
| 3,964,622 | A | * | 6/1976 | Blair et al. ..... 414/723 |
| 3,985,249 | A | | 10/1976 | Aker et al. |
| 4,030,624 | A | | 6/1977 | Matthews |
| 4,068,959 | A | | 1/1978 | Pemberton |
| 4,127,203 | A | | 11/1978 | Arnold |
| 4,136,792 | A | | 1/1979 | Wilson |
| 4,179,225 | A | | 12/1979 | Asplund |
| 4,187,050 | A | | 2/1980 | Barbee |

FOREIGN PATENT DOCUMENTS

| | | |
|---|---|---|
| EP | 0 052 987 | 6/1982 |
| EP | 0 143 074 | 5/1985 |

(List continued on next page.)

OTHER PUBLICATIONS

J.B. International Ltd., "World's No. 1 J.B. Loader–Excavator Quick Coupler." 2 pages.
Hendrix Manufacturing Company Inc., "The Most Versatile Coupler in the World," 5 pages. Jun. 1989.
Swift Hitch, "How Would you Change a Bucket in Seven Seconds? All it Takes is One Finger," 4 pages.

(List continued on next page.)

*Primary Examiner*—Lynne H. Browne
*Assistant Examiner*—John R. Cottingham
(74) *Attorney, Agent, or Firm*—Fish & Richardson P.C.

(57) ABSTRACT

A quick coupler for attaching a tool having first and second generally parallel pins to an excavator or the like has a coupler body and a lock plate assembly. The coupler body includes a pair of generally parallel sidewall plates spaced from and generally parallel to each other, and a set of cross members extending generally between the sidewall plates. The set of cross members includes at least first and second cross members spaced from each other and defining a slide port. The pair of sidewall plates defines a first slot facing in a first direction for engagement with the tool first pin and a second slot facing in a second direction transverse to the first direction for engagement with the tool second pin. The lock plate assembly, for releasable securing engagement of the second slot with the second pin, includes a lock plate and a lock pin. The lock plate is moveable relative to the coupler body along a lock plate axis generally transverse to a longitudinal axis of the second pin, between a first lock plate position engaged with the slide port for obstructing the second slot to secure engagement of the second slot with the second pin, and a second lock plate position removed from obstruction of the second slot for removal or insertion of the second pin in engagement with the second slot. The lock pin, for releasable engagement with the lock plate, is moveable between a first lock pin position engaged with the lock plate in manner to resist removal of the lock plate from its first position engaged with the slide port, and a second lock pin position releasing the lock plate.

7 Claims, 5 Drawing Sheets

U.S. PATENT DOCUMENTS

| | | | | |
|---|---|---|---|---|
| 4,214,840 | A | | 7/1980 | Beales |
| 4,243,356 | A | | 1/1981 | Takojima |
| 4,251,181 | A | | 2/1981 | Drott et al. |
| 4,279,085 | A | | 7/1981 | Arnold |
| 4,311,428 | A | | 1/1982 | Arnold |
| 4,345,872 | A | | 8/1982 | Arnold |
| 4,355,945 | A | | 10/1982 | Pich |
| 4,397,604 | A | | 8/1983 | McCain |
| 4,417,844 | A | | 11/1983 | De Pingon |
| 4,436,477 | A | | 3/1984 | Lenertz et al. |
| 4,457,085 | A | | 7/1984 | Arnold |
| 4,480,955 | A | | 11/1984 | Andrews et al. |
| 4,586,867 | A | | 5/1986 | Stafford |
| 4,593,791 | A | | 6/1986 | Matthews |
| 4,726,731 | A | | 2/1988 | Jones |
| 4,736,673 | A | | 4/1988 | Harada et al. |
| 4,787,237 | A | | 11/1988 | Houston et al. |
| 4,810,162 | A | | 3/1989 | Foster |
| 4,824,319 | A | | 4/1989 | Arnold |
| 4,833,760 | A | | 5/1989 | Sundstrom |
| 4,850,790 | A | | 7/1989 | Johnson et al. |
| 4,871,292 | A | | 10/1989 | Milanowski |
| 4,881,867 | A | | 11/1989 | Essex et al. |
| 4,955,779 | A | | 9/1990 | Knackstedt |
| 4,984,957 | A | | 1/1991 | Noguchi et al. |
| 5,010,962 | A | | 4/1991 | Bloom, Jr. |
| 5,049,027 | A | | 9/1991 | Morrison et al. |
| 5,082,389 | A | | 1/1992 | Balemi |
| 5,107,610 | A | | 4/1992 | Fusco |
| 5,110,254 | A | | 5/1992 | Aubrey |
| 5,147,173 | A | | 9/1992 | Fauber et al. |
| 5,256,026 | A | | 10/1993 | Kishi |
| 5,324,162 | A | | 6/1994 | Kishi |
| 5,332,353 | A | | 7/1994 | Arnold |
| 5,333,695 | A | | 8/1994 | Walter |
| 5,350,250 | A | | 9/1994 | Nagler |
| 5,400,531 | A | | 3/1995 | Brown |
| 5,467,542 | A | | 11/1995 | Hulden |
| 5,494,396 | A | | 2/1996 | Geier et al. |
| 5,546,683 | A | | 8/1996 | Clark |
| 5,597,283 | A | | 1/1997 | Jones |
| 5,618,157 | A | | 4/1997 | Pratt et al. |
| 5,634,735 | A | * | 6/1997 | Horton et al. ..... 403/322.1 |
| 5,727,342 | A | | 3/1998 | Horton |
| 5,802,753 | A | | 9/1998 | Raunisto |
| 5,890,871 | A | * | 4/1999 | Woerman ..... 414/723 |
| 5,966,850 | A | | 10/1999 | Horton |
| 6,233,852 | B1 | * | 5/2001 | Pemberton ..... 37/468 |

FOREIGN PATENT DOCUMENTS

| | | |
|---|---|---|
| EP | 0 184 282 | 6/1986 |
| EP | 0 273 828 | 7/1988 |
| EP | 0 477 119 | 9/1991 |
| GB | 1 492 504 | 11/1977 |
| GB | 2 120 634 | 12/1983 |
| GB | 2 169 582 | 7/1986 |
| GB | 2 172 045 | 9/1986 |
| GB | 2 205 299 | 12/1988 |
| GB | 2 208 220 | 3/1989 |
| JP | 55065639 | 5/1980 |
| RU | 1021-722 A | 6/1983 |
| WO | WO88/03198 | 5/1988 |

OTHER PUBLICATIONS

Caterpillar D8N Track–Type Tractor, Brochure, pp. 4 & 5, Jun. 1996.

John Deere, 690E LC Excavator, Brochure, pp. 2, Jun. 1996.

O.E.M. Bucket Couplers (J.R.B. Pat. No. 4,726,731) Brochure Copy.

Adjust–Bucket (Pat. No. 3,231,116) Brochure Copy.

Hendrix Brochure Copy.

* cited by examiner

DIRECT PIN QUICK COUPLER

TECHNICAL FIELD

This invention relates to couplers for attaching excavator buckets and other tools to heavy construction equipment.

BACKGROUND

Quick couplers have been widely used with excavating equipment, e.g. hydraulic excavators (backhoes), to allow individual pieces of equipment to be used with a variety of tools, e.g., different buckets, grapples and the like, without extended downtime for changing tools. Conventional quick couplers are described, e.g., in U.S. Pat. Nos. 4,726,731 and 3,231,116. Quick couplers typically consist of a pair of spaced parallel plates, the plates defining holes for fixed attachment of the coupler to the end of a backhoe. The plates also define a first slot facing generally forward to engage a first pin on the bucket or tool, and a second slot, facing generally downward (i.e., disposed at 90° to the first slot) to engage a second pin on the bucket or tool. In operation, the first pin is engaged in the first slot. The coupler is then rotated about the longitudinal axis of the first pin to engage the second pin in the second slot. The coupler and tool are thereafter secured together by engagement, e.g., of a coupler gate with the second pin. This coupler gate is typically pivotally mounted to a pin on the coupler such that it pivots about a horizontal axis parallel to the longitudinal axes of the first and second slots/pins. These conventional couplers can be rendered virtually unusable by a relatively small degree of wear in the slots. This problem of wear in a conventional coupler was addressed in Arnold U.S. Pat. No. 5,332,353, the complete disclosure of which is incorporated herein by reference.

SUMMARY

According to the invention, a quick coupler for attaching a tool having first and second generally parallel pins to an excavator or the like comprises a coupler body with a pair of sidewall plate members disposed spaced from and generally parallel to each other, and a set of cross members extending generally between the sidewall plate members, the set of cross members comprising at least first and second cross members spaced from each other and defining a slide port, and the pair of sidewall plate members defining a first slot facing in a first direction for engagement with the first pin of the tool and a second slot facing in a second direction transverse to the first direction for engagement with the second pin of the tool; and a lock plate assembly for releasable securing engagement of the second slot with the second pin comprising a lock plate moveable relative to the coupler body along a lock plate axis generally transverse to a longitudinal axis of the second pin, between a first lock plate position engaged with the slide port for obstructing the second slot to secure engagement of the second slot with the second pin, and a second lock plate position removed from obstruction of the second slot for removal or insertion of the second pin in engagement with the second slot; and a lock pin for releasable engagement with the lock plate, the lock pin being moveable between a first lock pin position engaged with the lock plate in manner to resist removal of the lock plate from the first lock plate position engaged with the slide port, and a second lock pin position releasing the lock plate.

Preferred embodiments of the invention may include one or more of the following additional features. The set of cross members further comprises at least a third cross member extending between the sidewall plate members and disposed generally along the lock plate axis and beyond the second slot relative to the first and second cross members and in a position to support the lock plate in the first lock plate position. The lock plate in the second lock plate position is removed from the lock plate port. The lock pin, in the first lock pin position is engaged between the lock plate and at least one cross member of the set of cross members. In the first lock plate position, the at least one cross member and the lock plate define aligned apertures, and the lock pin, in the first lock pin position, is engaged in the aligned apertures. The lock plate further defines a stop member disposed for engagement with at least one of the first and second cross members for terminating movement of the lock plate along the lock plate axis between the first lock plate position and the second lock plate position. The stop member defines a handle surface for the lock plate for movement from the second lock plate position toward the first lock plate position.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

It will also be noted that the figures are generally not drawn to scale.

DETAILED DESCRIPTION

Figure 1:
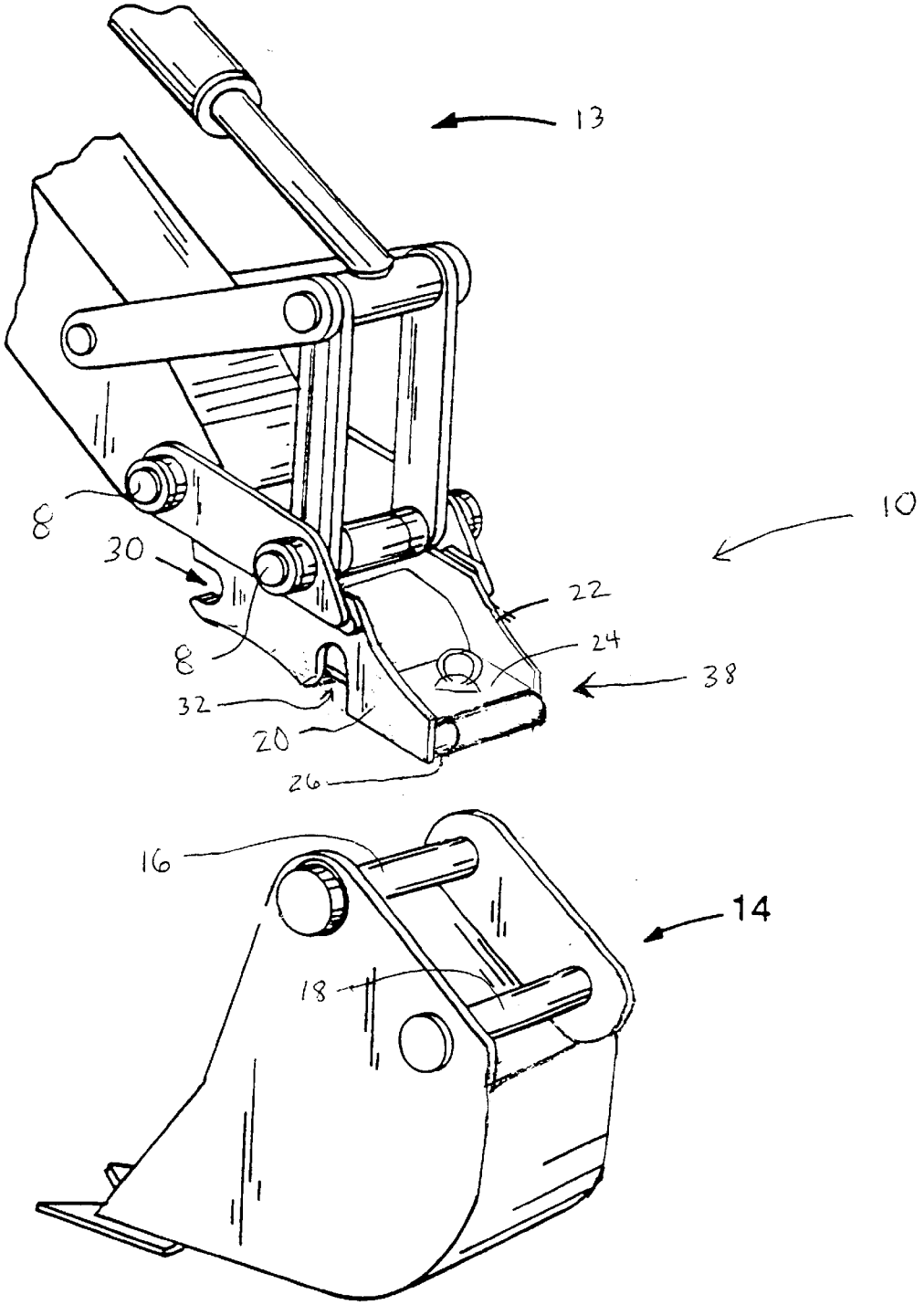
FIG. 1 is a perspective view of an unattached bucket and backhoe arm with an improved quick coupler according to one embodiment of the invention.
Figure 3:
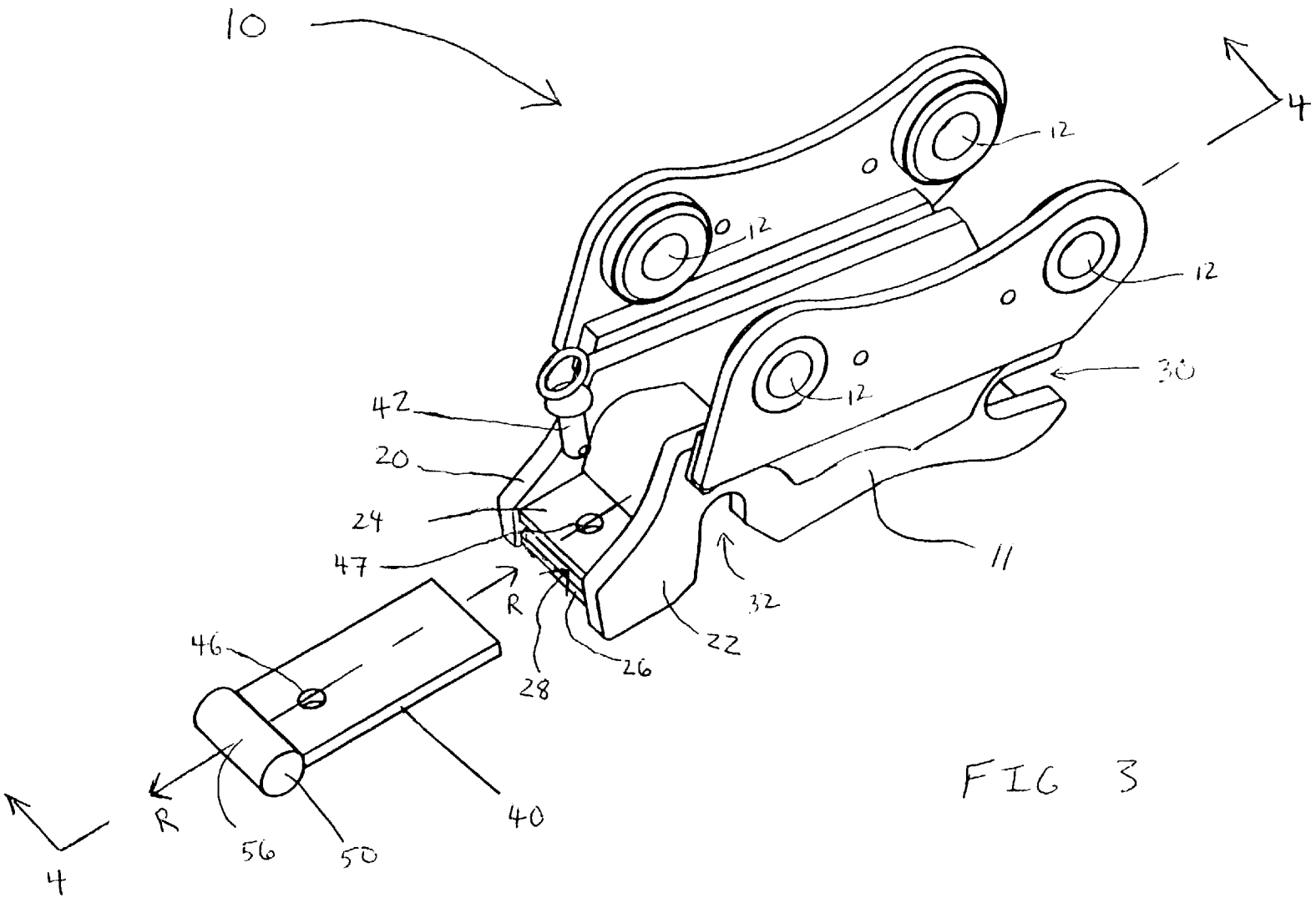
FIG. 3 is a perspective view of the improved quick coupler of FIG. 2 with the lock plate in open position.

Referring to FIG. 1, an improved quick coupler 10 of the invention is shown attached to the arm 13 of a backhoe (not shown) by means of pins 8 extending through apertures 12 (shown in FIG. 3). The quick coupler 10, which may, of course, be mounted in any other conventional manner, permits attachment of a range of tools, e.g., buckets, grapples and the like, having first and second generally parallel pins (as described below), to a backhoe or other excavator.

The quick coupler 10 has a coupler body 11 consisting of a pair of sidewall plate members 20, 22 disposed spaced from and generally parallel to each other, and a set of cross members extending generally between the sidewall plate members 20, 22. The set of cross members includes first and second cross members 24, 26 disposed generally parallel and spaced from each other to define a slide port 28, to be discussed in more detail below. The sidewall plate members 20, 22 together define a first slot 30 facing in a first direction for engagement with the first pin 16 of the tool 14, and a second slot 32 facing in a second direction, transverse to the first direction, for engagement with the second pin 18 of the tool 14.

The quick coupler 10 further consists of a lock plate assembly 38 for releasable securing-engagement of the second slot 32 with the second pin 18. The lock plate assembly 38 includes a lock plate 40 and a lock pin 42.

Figure 2:
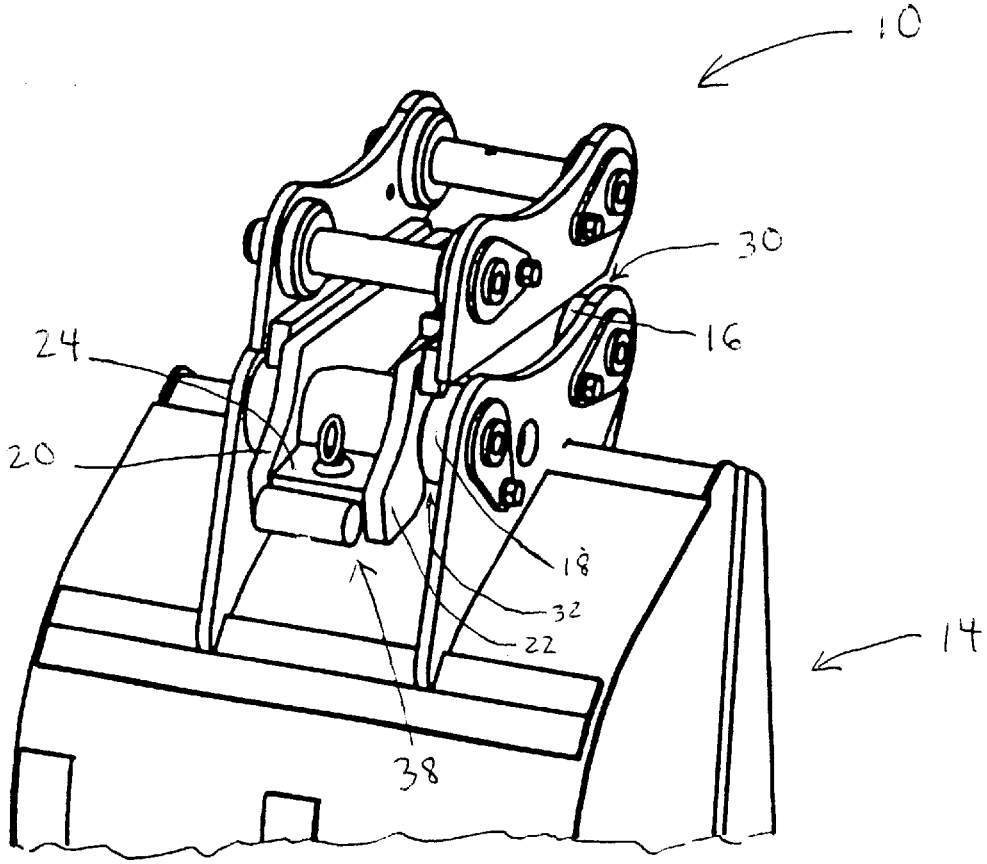
FIG. 2 is a perspective view of an improved quick coupler according to one embodiment of the invention attached to a bucket.
Figure 4:
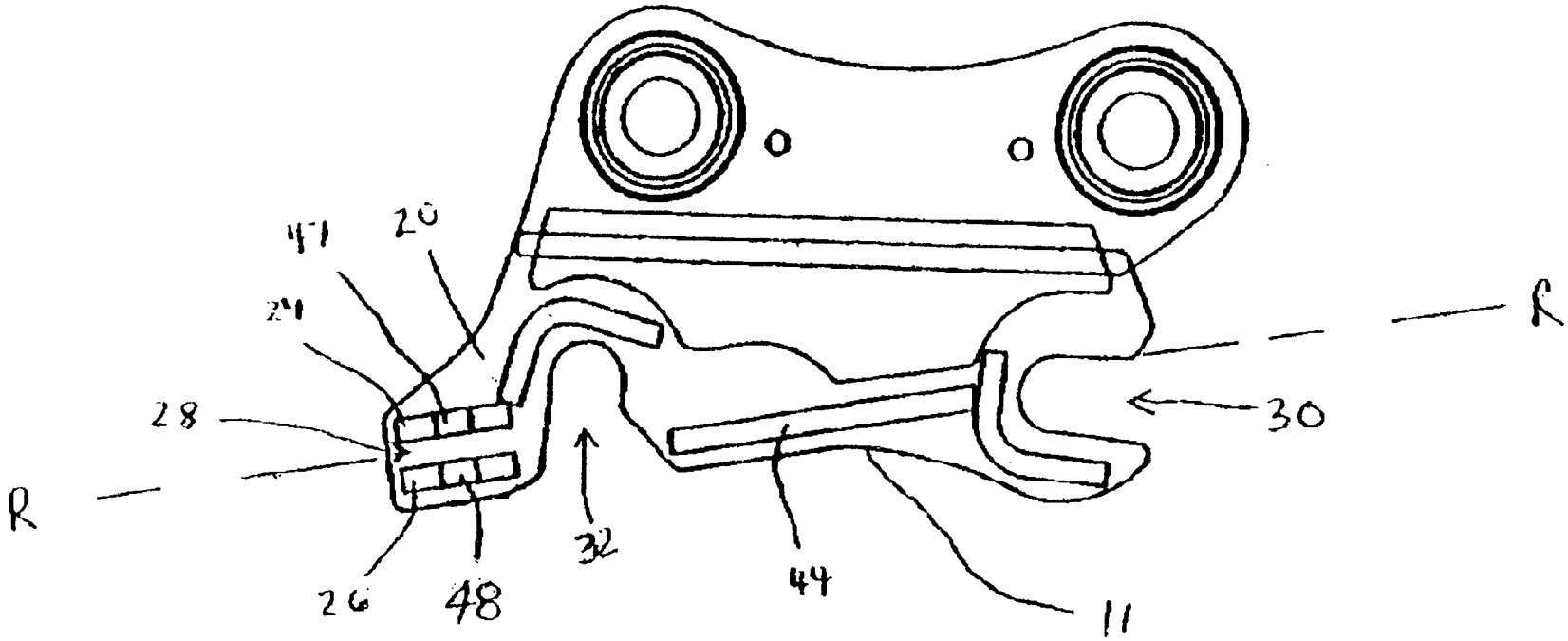
FIG. 4 is a cross sectional view of the improved quick coupler taken along line 4—4 of FIG. 3 with the lock plate assembly removed.
Figure 5:
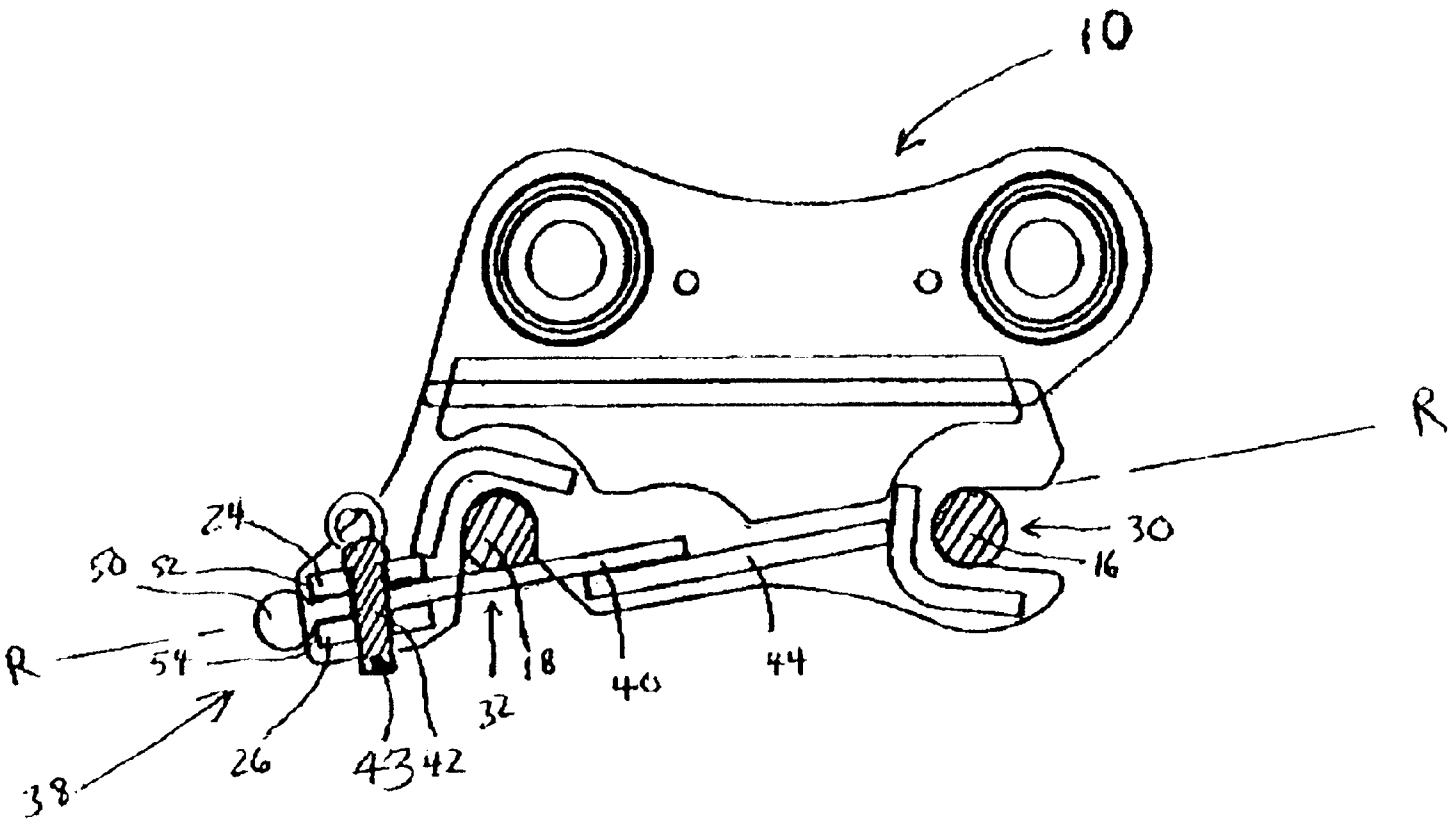
FIG. 5 is a cross-sectional view of the improved quick coupler taken along line 4—4 of FIG. 3 secured to bucket attachment pins with the lock plate assembly in the closed position.

The lock plate 40 is moveable relative to the coupler body 11 along a lock plate axis R—R (FIG. 3) generally transverse to a longitudinal axis of the second pin 18, between a first lock plate position (e.g., as shown in FIGS. 2 and 5) engaged with the slide port 28 for obstructing the second slot 32 to secure engagement of the second slot 32 with the second pin 18, and a second lock plate position (e.g., as shown in FIGS. 3 and 4) removed from obstruction of the second slot 32 (and, in the preferred embodiment, removed from the slot) to permit removal or insertion of the second pin 18 into or from engagement with the second slot 32. The set of cross members also includes a third cross member 44 extending between the sidewall plate members 20, 22 and disposed generally along the lock plate axis R—R and beyond the second slot 32 relative to the first and second cross members 24, 26, in a position to support the lock plate 40 in its first lock plate position.

The lock pin 42, constructed for releasable engagement with the lock plate 40, is moveable between a first lock pin position engaged in apertures 46, 47, 48 defined by the lock plate 40, first cross member 24, and second cross member 26, respectively, the apertures 46, 47, 48 being in alignment when the lock plate 40 is in its first position, in the slide port 28, and a second lock pin position when the lock pin 42 is removed from engagement in apertures 46, 47, 48. Engagement of the lock pin 42 in the aligned apertures 46, 47, 48 resists removal of the lock plate 40 from the first lock plate position engaged with the slide port 28. The lock pin 42 is selectively removable to release the lock plate 40, and may be secured against dislodgement from its first position, e.g., by a clip pin or the like engaged in aperture 43 adjacent the inner end of the lock pin 42.

The lock plate 40 has an enlarged stop member 50 at its outer end which is sized and constructed to engage with the end surfaces 52, 54 of the first and second cross members 24, 26 when the lock plate 40 is fully inserted into the slide port 28, with the apertures 46, 47, 48 of the lock plate 40, first cross member 24, and second cross member 26 in alignment. The stop member 50 also defines an exposed handle surface 56 to facilitate removal of the lock plate 40 from the slide port 28.

Movement of second pin 18 within second slot 32 during use increases wear, and makes the tool difficult and eventually impossible to use, thus, for efficient operation, it is desired that slot 32 and lock plate 40 tightly engage tool pin 18 when lock plate assembly 38 is in the first lock plate position. Because lock plate 40 is readily removable from the coupler body 11, it is easily repaired or replaced when wear becomes excessive.

A number of embodiments of the invention have been described. Nevertheless, it will be understood that various modifications may be made without departing from the spirit and scope of the invention. For example, the lock pin 42 may be secured in its rather than having the latch mechanism 38 manually actuated the latch mechanism 38 may be actuated by remote control, e.g., from the cab of the excavator, using hydraulic or pneumatic cylinders to move the latch lever. Accordingly, other embodiments are within the scope of the following claims.

What is claimed is:

1. A quick coupler for attaching a tool to an excavator, the tool having first and second generally parallel pins, said quick coupler comprising:

a coupler body comprising a pair of sidewall plate members disposed spaced from and generally parallel to each other, and a set of cross members extending generally between said sidewall plate members, said set of cross members comprising at least first and second cross members spaced from each other and defining a slide port, and said pair of sidewall plate members defining a first slot facing in a first direction for engagement with the first pin of the tool and a second slot facing in a second direction transverse to said first direction for engagement with the second pin of the tool; and a lock plate assembly for releasable securing engagement of said second slot with the second pin, said lock plate assembly comprising:

a lock plate moveable relative to said coupler body along a lock plate axis generally transverse to a longitudinal axis of the second pin, between a first lock plate position engaged with said slide port for obstructing said second slot to secure engagement of said second slot with the second pin, and a second lockplate position removed from obstruction of said second slot for removal or insertion of the second pin in engagement with said second slot; and a lock pin for releasable engagement with said lock plate, said lock pin being moveable between a first lock pin position engaged with said lock plate in manner to resist removal of said lock plate from said first lock plate position engaged with said slide port, and a second lock pin position releasing said lock plate.

2. The quick coupler of claim 1, wherein said set of cross members further comprises at least a third cross member extending between said sidewall plate members and disposed generally along said lock plate axis and beyond said second slot relative to said first and second cross members and in a position to support said lock plate in said first lock plate position.

3. The quick coupler of claim 1, wherein said lock plate in said second lock plate position is removed from said slide port.

4. The quick coupler of claim 1, wherein said lock pin, in said first lock pin position is engaged between said lock plate and at least one cross member of said set of cross members.

5. The quick coupler of claim 4, wherein, in said first lock plate position, said at least one cross member and said lock plate define aligned apertures, and said lock pin, in said first lock pin position, in engaged in said aligned apertures.

6. The quick coupler of claim 1, wherein said lock plate further defines a stop member disposed for engagement with at least one of said first and second cross members for terminating movement of said lock plate along said lock plate axis between said first lock plate position and said second lock plate position.

7. The quick coupler of claim 6, wherein said stop member defines a handle surface for said lock plate for movement from said second lock plate position toward said first lock plate position.

* * * * *